US010300584B2

(12) United States Patent
Roehm

(10) Patent No.: US 10,300,584 B2
(45) Date of Patent: May 28, 2019

(54) POWER TOOL GEAR DEVICE

(75) Inventor: Heiko Roehm, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 1053 days.

(21) Appl. No.: 12/737,849

(22) PCT Filed: Jul. 15, 2009

(86) PCT No.: PCT/EP2009/059038

§ 371 (c)(1),
(2), (4) Date: May 3, 2011

(87) PCT Pub. No.: WO2010/023027

PCT Pub. Date: Mar. 4, 2010

(65) Prior Publication Data

US 2011/0220377 A1 Sep. 15, 2011

(30) Foreign Application Priority Data

Aug. 29, 2008 (DE) ..... 10 2008 041 718

(51) Int. Cl.
*B25F 5/00* (2006.01)
*B25B 21/00* (2006.01)

(52) U.S. Cl.
CPC ..... *B25B 21/00* (2013.01); *B25F 5/001* (2013.01)

(58) Field of Classification Search
CPC . B25F 5/001; B25F 5/00; B25B 21/00; B25B 21/02
USPC ..... 53/47, 48, 216, 217, 29
See application file for complete search history.

(56) References Cited

U.S. PATENT DOCUMENTS

| | | | | |
|---|---|---|---|---|
| 5,339,908 | A * | 8/1994 | Yokota et al. | 173/216 |
| 5,550,416 | A * | 8/1996 | Fanchang et al. | 310/83 |
| 7,044,882 | B2 * | 5/2006 | Eisenhardt | 475/298 |
| 2004/0198547 | A1 | 10/2004 | Eisenhardt | |

FOREIGN PATENT DOCUMENTS

| | | |
|---|---|---|
| CN | 1743138 | 3/2006 |
| CN | 1817569 | 8/2006 |
| EP | 1 464 427 | 10/2004 |
| EP | 2 077 177 | 7/2009 |

* cited by examiner

*Primary Examiner* — Andrew M Tecco
(74) *Attorney, Agent, or Firm* — Norton Rose Fulbright US LLP; Gerard Messina

(57) ABSTRACT

A power tool gear device has at least one first and one second gear stage, and a switching element which may be moved by an operator using an actuating element. The switching element at least partially surrounds at least one gear stage in at least one operating position along a circumferential direction and is configured to switch between a first and a second operating position. The switching element includes at least one first component and one second component.

16 Claims, 4 Drawing Sheets

POWER TOOL GEAR DEVICE

BACKGROUND OF THE INVENTION

1. Field of the Invention

The present invention is directed to a power tool gear device.

2. Description of Related Art

Power tool gear devices having a first and a second gear stage and having a switching element are already known, an operator being able to move the switching element using an actuating element, the switching element surrounding the first gear stage in an operating position along a circumferential direction and being provided to switch between a first and a second operating position.

BRIEF SUMMARY OF THE INVENTION

In a power tool gear device having at least one first and one second gear stage and having a switching element which may be moved by an operator using an actuating element, the switching element at least partially surrounding at least one gear stage in at least one operating position along a circumferential direction and being provided to switch between a first and a second operating position, the switching element includes at least one first component and one second component. In this connection, "provided" is understood to mean, in particular, specially equipped and/or specially designed. The term "gear stage" in this case is understood to mean, in particular, a system of toothed wheels, in particular planetary carriers, ring gears, planetary wheels and sun wheels, in a gear, in particular a planetary gear, which is provided to transmit preset torques and/or rotational speeds, and/or to gear down and/or gear up torques and/or rotational speeds. The torque and/or the rotational speed and/or a gearing down and/or gearing up of the torque and/or the rotational speed may preferably be changed with the aid of the switching element.

An "actuating element" in this case is understood to mean, in particular, an element and/or component, in particular an element and/or component which may be actuated directly by an operator and which is operatively connected to a further element and/or component, in particular the switching element, and which is provided for the purpose of switching the further element and/or component from one state to another state. The actuating element is preferably formed by a component which is separate from the switching element. The actuating element is operatively connected to the switching element via an outer geometry of the switching element, which enables forces to be transmitted from the actuating element to the switching element.

An "operating position" in this case defines, in particular, a position, such as a switching position, of the switching element within a gear, in particular a planetary gear, in which a defined torque and/or a defined rotational speed may be transmitted to a shaft and/or to toothed wheels of the gear via the gear. The term "circumferential direction" in this case is understood to be a direction perpendicular to a rotation axis of an output shaft of the power tool gear device, the circumferential direction running circumferentially around the rotation axis of the output shaft of the power tool gear device. The expression "surrounding along a circumferential direction" in this case is defined as a covering of at least one element and/or component by at least one further element and/or component in a radial direction. The radial direction runs perpendicular to the rotation axis of the output shaft of the power tool gear device. A system of toothed wheels, in particular a system of a planetary carrier, a ring gear, planetary wheels and/or a sun wheel, are preferably to be covered by at least one component of the switching element in the radial direction.

The power tool gear device is advantageously provided for hand-held electric tools such as screwdrivers, combi drills and percussion drills and, in particular, for cordless screwdrivers, cordless combi drills and cordless percussion drills, to gear down a motor speed of approximately 20,000 rpm to a speed range between approximately 150 rpm and 2,000 rpm which is useful for a working spindle of the handheld electric tool. Due to the design of the power tool gear device according to the present invention, an operator may switch between a first and a second operating position particularly comfortably; it being possible to switch from a first gear of the power tool gear device having a low rotational speed and a high torque to a second gear of the power tool gear system having a high rotational speed and a low torque. In this case, a switching operation may be particularly advantageously achieved while operating the power tool gear device under load.

It is furthermore proposed that the switching element is designed as a switching ring gear. The switching ring gear is particularly advantageously provided for a planetary gear. Due to a design of this type, the switching element may be easily structurally integrated into existing power tool gear devices, and costs and assembly complexity may be advantageously reduced.

Advantageously, the first component is formed at least partially by a first ring element, and the second component is formed at least partially by a second ring element. The first ring element and the second ring element each advantageously have a longitudinal extent which runs along the entire circumferential direction in such a way that the first ring element has a closed configuration and the second ring element also has a closed configuration. Due to the design of the components as ring elements according to the present invention, a compact power tool gear device may be achieved.

It is furthermore proposed that the first component is at least partially covered by the second component along a radial direction at least in one operating position. This makes it possible to advantageously use an existing installation space, and a simple combination of functions of the components may be achieved. A high degree of comfort in operating the power tool gear device may also be achieved.

In addition, it is proposed that the first component and the second component largely surround a receptacle area. The receptacle area preferably runs along the circumferential direction in the manner of a ring segment. The receptacle area may be divided into multiple independent sections along the circumferential direction. Furthermore, the receptacle area may be largely covered by the first component and the second component in an axial direction and in the radial direction. The axial direction runs largely parallel to the rotation axis of the output shaft of the power tool gear device. The term "largely parallel" in this case is understood to mean, in particular, a direction which has a deviation of, in particular, less than 8°, preferably less than 5° and particularly advantageously less than 2° in relation to a reference direction. The receptacle area may be advantageously used to achieve a protecting function for an element and/or a component situated in the receptacle area, and wear on the element and/or the component may be advantageously reduced.

Preferably, the first component is movably mounted relative to the second component. The first component may particularly advantageously move relative to the second component along the circumferential direction, making it possible to advantageously compensate torque and/or rotational speed differences during a switching operation between the first and the second operating positions. However, it is also possible that the first component may move relative to the second component along the axial direction. A switching element of a structurally simple design may be achieved thereby.

The first component advantageously includes at least one locking element. A "locking element" in this case is understood to be, in particular, an element and/or component which is provided to prevent the element and/or component from moving relative to a further element and/or component via a positive fit and/or a non-positive fit. The locking element is preferably provided to form a positive connection. The locking element is particularly advantageously designed to form a single piece with the first component. "Single piece" is understood to mean, in particular, formed as a single part and/or from a single casting and/or designed as one component. The locking element is preferably designed as a locking geometry in the form of a partial outer toothed structure, in particular a spur toothed structure and/or a partial inner toothed structure, of the first component. A one-piece design makes it possible to advantageously save installation space and reduce assembly complexity and costs. The first component may also be advantageously held in a desired position by the locking element. The locking geometry may be advantageously provided as a means of preventing the first component from twisting relative to a housing in which the power tool gear device is situated.

The switching element advantageously has at least one further component which is at least partially formed by an elastic element. In this connection, an "elastic element" defines an elastically resilient element and/or component, such as a cup spring, an elastomer and/or other elastically resilient elements which appear practical to those skilled in the art. However, the elastic element is particularly advantageously designed as a helical spring. The elastic element preferably has a function of a damping means, which makes it possible to advantageously protect components and reduce wear.

In addition, it is proposed that the first component is operatively connected to the second component at least via the elastic element. The elastic element is preferably provided to ensure a relative movement between the components. A design of this type makes it possible to achieve an advantageous combination of functions of the components. A switching operation may be particularly advantageously achieved during operation of the power tool gear device, such as during application of a driving torque.

The elastic element is preferably situated between the first component and the second component along at least one direction. "Between" in this case is understood to mean, in particular, a positioning in space along the radial direction and/or the axial direction. The elastic element is preferably situated in the receptacle area surrounded by the first component and the second component. This makes it possible to achieve a protective function of the elastic element and, furthermore, it is possible to achieve a compact system of components within the power tool gear device.

It is furthermore proposed that the first component has at least one positive-locking element which is provided so that the second component at least partially engages behind the second component in an axial direction. A "positive-locking element" in this case is understood to be, in particular, an element and/or a component which is provided to form a positive fit with a further element and/or component. The positive-locking element is preferably designed to form a single piece with the first component, which makes it possible to advantageously save installation space and components. Due to the positive-locking element, a secure coupling of the components may be advantageously achieved, and a structurally simple power tool gear device may be achieved.

The first component advantageously has at least one supporting element which runs in a radial direction, the supporting element being oriented in the direction of the second component. A "supporting element" in this case is understood to be, in particular, an element and/or component which is designed as a contact surface and/or a stop for a further element and/or component, in particular the elastic element, in particular to absorb and/or to transmit forces and/or to introduce forces into the further element and/or component. The supporting element is preferably designed as a single piece with the first component, thereby making it possible to achieve an advantageous and structurally simple means of introducing force into the component.

In addition, it is proposed that the second component has at least one supporting element which runs in a radial direction, the supporting element being oriented in the direction of the first component. The supporting element is preferably designed as a single piece with the second component. This makes it possible to achieve a structurally simple functional coupling of the components, such as, in particular, a relative movement between the components, it being possible to dampen the relative movement by the elastic element to prevent torque shocks. Furthermore, installation space, components, assembly complexity and costs may be reduced. This may be particularly advantageously achieved by providing the supporting elements for the purpose of at least partially transmitting a force from the first component to the second component.

DETAILED DESCRIPTION OF THE INVENTION

Figure 1:
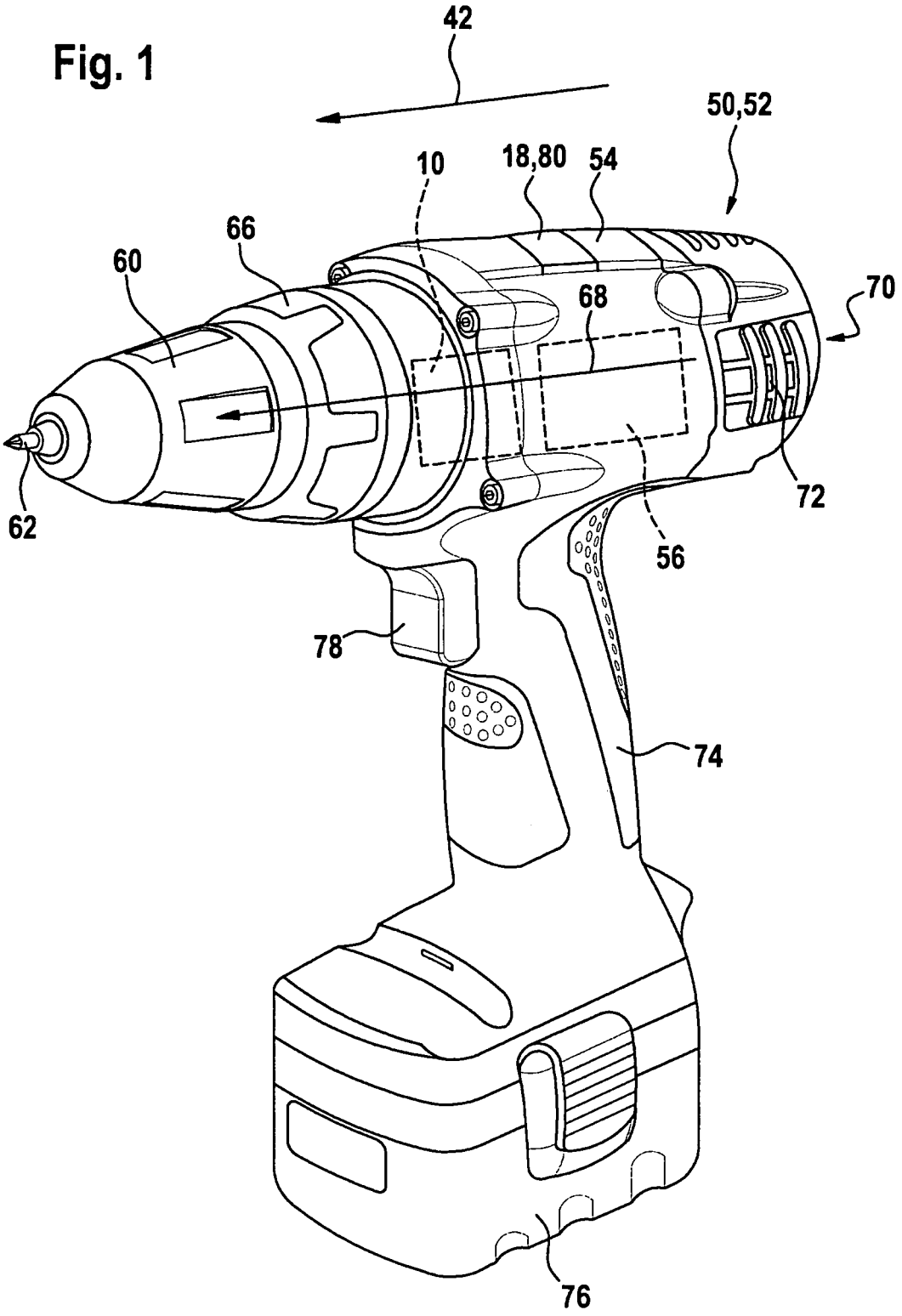
FIG. 1 shows a handheld electric power tool having a power tool gear device according to the present invention in a schematic representation.

FIG. 1 shows a handheld electric power tool 52 designed as a cordless screwdriver 50 having a power tool gear device 10 according to the present invention in a schematic representation. Cordless screwdriver 50 includes a multiple-part housing 54 in which power tool gear device 10 and a motor unit 56 are situated, and a tool receptacle 60 into which a tool 62 may be inserted. Tool 62 may be driven in a rotary manner by an output shaft 64 (see FIG. 2) of power tool gear device 10, which is operatively connected to tool receptacle 60. Furthermore, cordless screwdriver 50 includes an adjusting ring 66 situated on tool receptacle 60, which is provided to adjust a torque which is transmittable to tool receptacle 60. A main extent direction 68 of cordless screwdriver 50 extends from a side 70 of housing 54, on which cooling openings 72 are situated, in the direction of tool receptacle 60. A handle 74, which is provided for guiding cordless screwdriver 50 by an operator, is situated on housing 54 largely perpendicularly to main extent direction 68. Handle 74 is designed to form a single piece with housing 54. A battery pack 76 is attached to handle 74. Handle 74 further includes an operating switch 78 having electric contacts which are provided to establish or interrupt an electric supply of motor unit 56 by battery pack 76 when operating switch 78 is pressed. Furthermore, an operating element 18, which is designed as a switch 80, is situated on the side of housing 54 facing away from handle 74. Switch 80 is movably mounted along main extent direction 68 of cordless screwdriver 50 in the axial direction. The operator may move a switching element 16 (see FIG. 2) of power tool gear device 10 along an axial direction 42, using switch 80. Axial direction 42 largely runs parallel to main extent direction 68 of cordless screwdriver 50.

Figure 2:
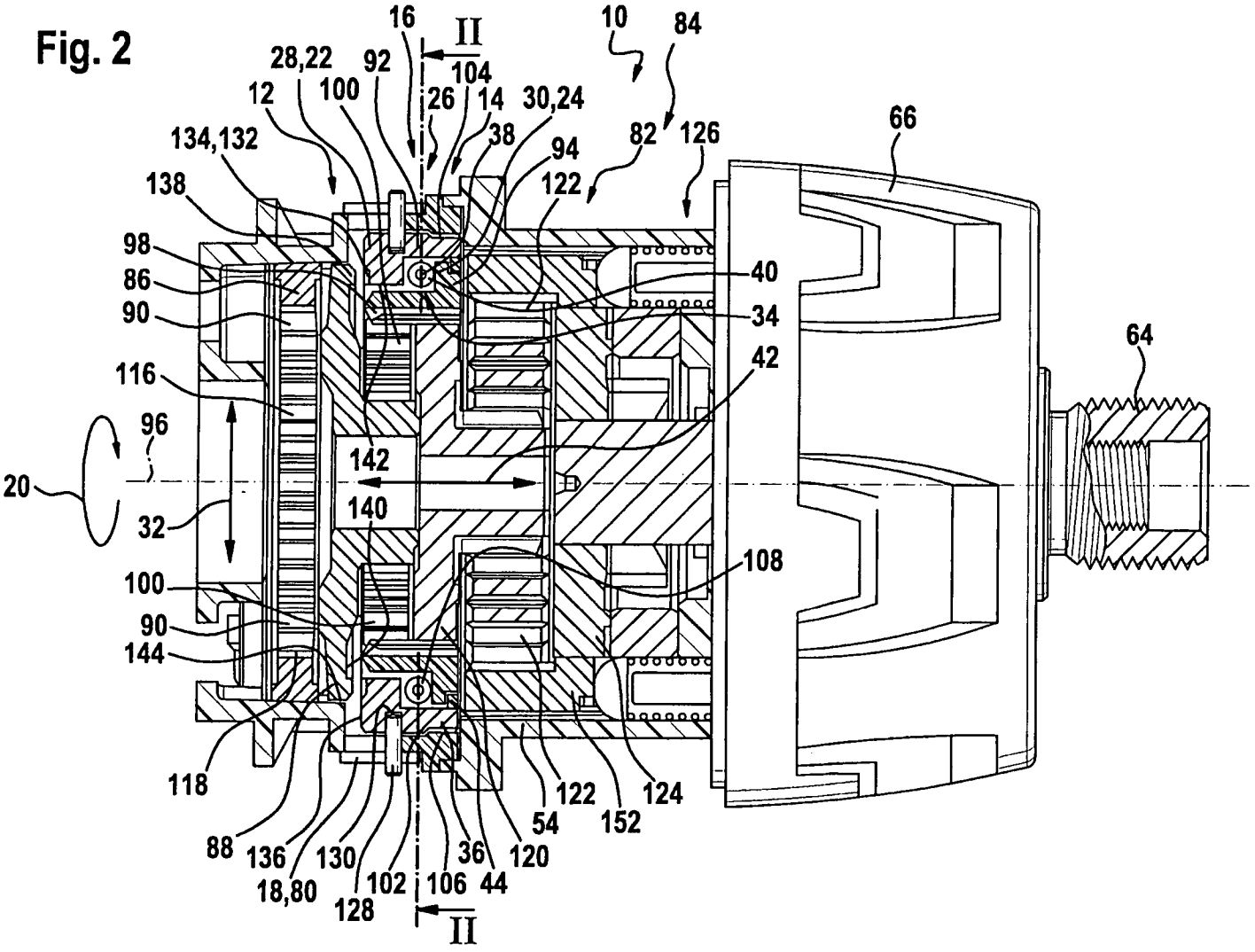
FIG. 2 shows a detailed view of the power tool gear device according to the present invention in a schematic representation.

FIG. 2 shows a detailed view of power tool gear device 10 according to the present invention in a schematic representation. Power tool gear device 10 includes a planetary gear 84 having a first, second and third gear stage 12, 14, 82. Gear stages 12, 14, 82 each include a ring gear 86, 94, 152, a planetary carrier 88, 120, 124 and multiple planetary wheels 90, 100, 122 which are situated on planetary carrier 88, 120, 124. Power tool gear device 10 furthermore includes switching element 16, which may be moved by the operator using switch 80. Switching element 16 is designed as a switching ring gear 26. Switching ring gear 26 includes a first component 22 and a second component 24. First component 22 is formed by a first ring element 28, which is designed as switching ring 92. Second component 24 is formed by a second ring element 30, which is designed as ring gear 94 of second gear stage 14. In a first operating position, switching ring 92 covers ring gear 94 of second gear stage 14 along a radial direction 32, which runs perpendicularly to a rotation axis 96 of output shaft 64. Ring gear 94 of second gear stage 14 includes an inner toothed structure 98 with which planetary wheels 100 of second gear stage 14 mesh. In the first operating position of power tool gear device 10, switching ring 92 also surrounds second gear stage 14 of planetary gear 84 along a circumferential direction 20, which runs perpendicularly to rotation axis 96 of output shaft 64 and extends circumferentially around rotation axis 96 of output shaft 64.

Switching ring gear 26 is furthermore provided to switch between the first operating position and a second operating position of power tool gear device 10. The first operating position forms a first gear of planetary gear 84. In first gear, low rotational speeds and a high torque are transmitted to output shaft 64, and thus to tool 62 in tool receptacle 60, during operation of planetary gear 84. The second operating position forms a second gear of planetary gear 84. In second gear, high rotational speeds and a low torque are transmitted to output shaft 64 during operation of planetary gear 84. During a switching operation while cordless screwdriver 50 is being operated, switching ring gear 26 is moved by the operator along axial direction 42, using switch 80. Axial direction 42 runs parallel to rotation axis 96 of output shaft 64 of power tool gear device 10.

In the first gear of planetary gear 84, switching ring gear 26 is non-twistably connected to housing 54 of cordless screwdriver 50 using a first locking element 36 of switching ring 92. First locking element 36 is designed in the form of a first outer toothed structure 102. First outer toothed structure 102 runs along circumferential direction 20 on an outer side 104 of switching ring 92 and extends in radial direction 32 in the direction of housing 54. Housing 54 correspondingly includes an inner toothed structure 106, with which first outer toothed structure 102 of switching ring 92 engages.

Figure 3:
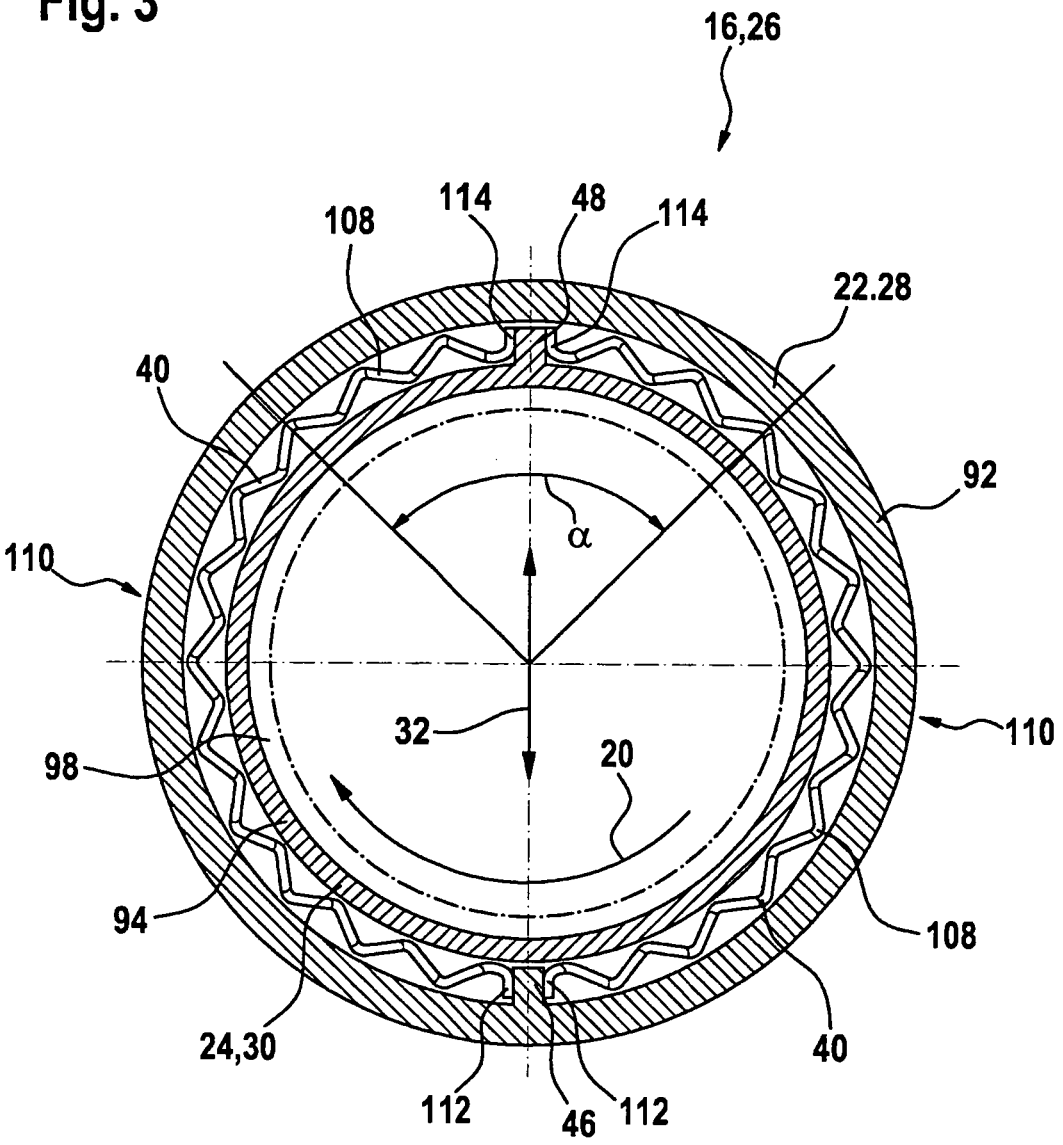
FIG. 3 shows a detailed view of a cross section of a switching element of the power tool gear device according to the present invention along line II-II from FIG. 2 in a schematic representation.

Furthermore, switching ring gear 26 includes a receptacle area 34, which is largely surrounded by switching ring 92 and ring gear 94 of second gear stage 14. Switching ring 92 and ring gear 94 of second gear stage 14 cover receptacle area 34 along radial direction 32 and axial direction 42. Receptacle area 34 is provided for accommodating at least one further component 38 of switching ring gear 26. Further component 38 is designed as elastic element 40. A total of two elastic elements 40, which are designed as helical springs 108, are situated in receptacle area 34. For this purpose, receptacle area 34 is divided into two spatially separated sections 110 along circumferential direction 20, one of helical springs 108 being situated in each section 110. However, it is conceivable for receptacle area 34 to be divided into more than two sections 110 and for a corresponding number of helical springs 108 to be situated in sections 110. To divide receptacle area 34, switching ring 92 has a supporting element 46 which runs in radial direction 32 and is oriented in the direction of ring gear 94 of second gear stage 14. However, it is conceivable for switching ring 92 to have multiple supporting elements 46 for the purpose of dividing, depending on the number of sections 110. Ring gear 94 of second gear stage 14 furthermore has a supporting element 48 which is oriented in the direction of switching ring 92. Those skilled in the art will also provide ring gear 94 of second gear stage 14 with a corresponding number of supporting elements 48, depending on the number of sections 110. Helical springs 108 are supported, in each case, on supporting element 46 of switching ring 92 by one end 112, and helical springs 108 are supported on supporting element 48 of ring gear 94 of second gear stage 14 by opposite end 114 in each case. Switching ring 92 is thus operatively connected to ring gear 94 of second gear stage 14 via helical springs 108. A force is transmitted from switching ring 92 to ring gear 94 of second gear stage 14 with the aid of switching elements 46, 48 and helical springs 108. Switching ring 92 is movably mounted over an angle range having an angle $\alpha$ of at least 90° along circumferential direction 20 relative to ring gear 94 of second gear stage 14, due to the system of helical springs 108 in receptacle area 34 (see FIG. 3). Helical springs 108 are situated between switching ring 92 and ring gear 94 of second gear stage 14 along axial direction 42. Helical springs 108 are furthermore situated between switching ring 92 and ring gear 94 of second gear stage 14 along radial direction 32.

During operation of cordless screwdriver 50, power tool gear device 10 is driven by a shaft of motor unit 56, on which a driving pinion 116 of power tool gear device 10 is situated. Driving pinion 116 engages with planetary wheels 90 of first gear stage 12. Planetary wheels 90 of first gear stage 12 mesh with an inner toothed structure 118, which is situated along circumferential direction 20 in a ring gear 86 of first gear stage 12, which is situated in a non-twistable manner in relation to housing 54, planetary wheels 90 driving planetary carrier 88 of first gear stage 12. Any point on planetary wheels 90 of first gear stage 12 executes a movement onto which two rotational movements are superimposed. A first of the two superimposed rotational movements is a self-rotation of planetary wheels 90 of first gear stage 12, and the second rotational movement is a rotation of planetary wheels 90 of first gear stage 12 around a rotation axis of driving pinion 116 of power tool gear device 10.

In first gear of planetary gear 84, planetary carrier 88 of first gear stage 12 drives planetary wheels 100 of second gear stage 14, any point on planetary wheels 100 of second gear stage 14 executing a movement onto which two rotational movements are superimposed. A first of the two superimposed rotational movements is a self-rotation of planetary wheels 100 of second gear stage 14, and the second rotational movement is a rotation of planetary wheels 100 of second gear stage 14 around a rotation axis of planetary carrier 88 of first gear stage 12. The movement of planetary wheels 100 of second gear stage 14, onto which two rotational movements are superimposed, is thus made possible by a non-twistable positioning of switching ring 92 and thus of ring gear 94 of second gear stage 14 in housing 54. Ring gear 94 of second gear stage 14 is positioned in a largely non-twistable manner in relation to housing 54 with the aid of helical springs 108 and supporting elements 46, 48 following a slight relative movement in relation to switching ring 92 and/or housing 54. The movement of planetary wheels 100 of second gear stage 14 drives a planetary carrier 120 of second gear stage 14. The latter, in turn, drives planetary wheels 122 of third gear stage 82, which drives a planetary carrier 124 of third gear stage 82 according to a principle which corresponds to driving first gear stage 12. Planetary carrier 124 is connected to output shaft 64 of power tool gear device 10 via a torque clutch 126. Torque clutch 126 may be set to a maximum transmittable torque desired by the operator, using adjusting ring 66. Torque clutch 126 operates in a manner already known to those skilled in the art.

During a switching operation of power tool gear device 10 from the first gear to the second gear of planetary gear 84, switching ring gear 26 is moved by the operator along axial direction 42 in the direction of first gear stage 12, using switch 80. For this purpose, switch 80 has a bolt 128 which engages with a groove 130 of switching ring 92 running in circumferential direction 20. When switching ring 92 moves along axial direction 42, the two helical springs 108 and ring gear 86 of first gear stage 12 are also moved along axial direction 42. For this purpose, switching ring 92 has a positive-locking element 44, which is provided for engaging behind ring gear 94 of second gear stage 14. Positive-locking element 44 is designed as a separate component which is fixedly connected to switching ring 92. Positive-locking element 44 is connected in a manner which appears practical to those skilled in the art, such as a screw connection, an adhesive connection, etc. When switching ring gear 26 moves along axial direction 42 in the direction of first gear stage 12, first outer toothed structure 102 of switching ring 92 disengages from inner toothed structure 106 of housing 54. Ring gear 94 of second gear stage 14 is subsequently accelerated by planetary wheels 100 of second gear stage 14 and placed in rotary motion, switching ring 92 being likewise accelerated and placed in rotary motion by an interaction between helical springs 108 and supporting elements 46, 48.

Furthermore, switching ring 92 includes a second locking element 132 in the form of a second outer toothed structure 134 which runs on a side 136 of switching ring 92 facing first gear stage 12 in circumferential direction 20 and is oriented along axial direction 42 in the direction of first gear stage 12. Second outer toothed structure 134 has steep edges which are provided to mesh with edges of an outer toothed structure 138 of planetary carrier 88 of first gear stage 12 to thus couple switching ring 92 with ring gear 86 of first gear stage 12 in a rotary manner. For this purpose, outer toothed structure 138 of planetary carrier 88 of first gear stage 12 runs on an outer side 140 of planetary carrier 88 of first gear stage 12 in circumferential direction 20 and is oriented along axial direction 42 in the direction of second gear stage 14. However, it is conceivable for switching ring gear 26 to include a second locking element 132 in the form of an inner toothed structure which runs on an inner side 142 of switching ring 92 in circumferential direction 20 and is oriented along radial direction 32 in the direction of ring gear 94 of second gear stage 14. Inner toothed structure would mesh with an outer toothed structure 138 of planetary carrier 88 of first gear stage 12, which would run on an end face 144 of planetary carrier 88 of first gear stage 12 in circumferential direction 20 and would be oriented along radial direction 32 in the direction of housing 54.

When second outer toothed structure 134 and/or inner toothed structure of switching ring 92 engage(s) with outer toothed structure 138 of planetary carrier 88 of first gear stage 12, a torque shock is produced between switching ring 92 and ring gear 94 of second gear stage 14, due to different rotational speeds of switching ring 92 and planetary carrier 88 of first gear stage 12. This torque shock is dampened by helical springs 108 between switching ring 92 and ring gear 94 of second gear stage 14. Switching ring 92 moves in a rotary manner relative to ring gear 94 of second gear stage 14 due to a deformation of helical springs 108. Furthermore, ring gear 94 of second gear stage 14 is likewise coupled in a largely rotary manner with ring gear 86 of first gear stage 12 via helical springs 108. In the second gear of planetary gear 84, switching ring gear 26 is thus coupled with planetary wheels 100 of second gear stage 14 and with planetary carrier 88 of first gear stage 12.

During a switching operation of power tool gear device 10 from the second gear to the first gear of planetary gear 84, switching ring gear 26 is moved by the operator along axial direction 42 in the direction of third gear stage 82, using switch 80. Second outer toothed structure 134 of switching ring 92 disengages from outer toothed structure 138 of planetary carrier 88 of first gear stage 12, which decouples planetary wheels 100 of second gear stage 14 from planetary carrier 88 of first gear stage 12. Due to the movement of switching ring gear 26 along axial direction 42 in the direction of third gear stage 82, first outer toothed structure 102 of switching ring 92 engages with inner toothed structure 106 of housing 54, a torque shock being produced between switching ring 92 and ring gear 94 of second gear stage 14 due to the engagement of outer toothed structure 102 of switching ring 92 with inner toothed structure 106 of housing 54. This torque shock is dampened by helical springs 108 between switching ring 92 and ring gear 94 of second gear stage 14. Switching ring gear 26 is connected to housing 54 in a largely non-twistable manner after the switching operation.

Figure 4:
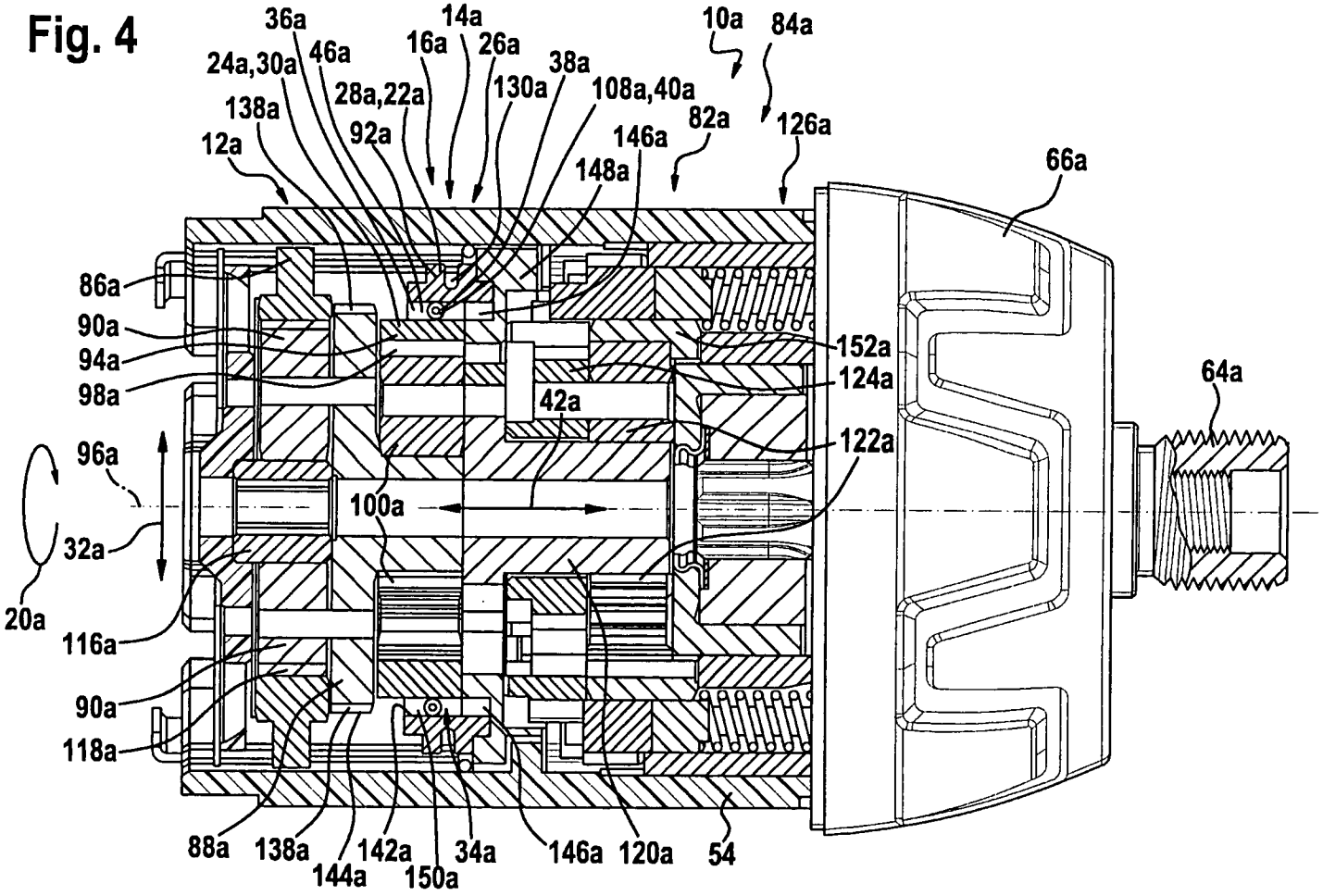
FIG. 4 shows a detailed view of a further power tool gear device having an alternative switching element in a schematic representation.

FIG. 4 shows an alternative exemplary embodiment. Components, features and functions which remain largely the same are, in principle, identified by the same reference numerals. To differentiate between the exemplary embodiments, however, the letter a is added to the reference numerals of the alternative exemplary embodiment. The following description is largely limited to the differences from the exemplary embodiment in FIGS. 2 and 3, it being possible to refer to the description of the exemplary embodiment in FIGS. 2 and 3 with regard to components, features and functions which remain the same.

FIG. 4 shows a detailed view of a power tool gear device 10*a* according to the present invention having an alternative switching element 16*a* in a schematic representation. Power tool gear device 10*a* is situated in a handheld electric power tool 52, as illustrated in FIG. 1. Power tool gear device 10*a* includes a planetary gear 84*a* having a first, second and third gear stage 12*a*, 14*a*, 82*a*, an operation of planetary gear 84*a* corresponding to the operation of planetary gear 84 in FIG. 2.

Power tool gear device 10*a* furthermore includes switching element 16*a*, which includes a first, second and third component 22*a*, 24*a*, 38*a*. First component 22*a* is designed as switching ring 92*a*. Second component 24*a* is designed as ring gear 94*a* of second gear stage 14*a*, and third component 38*a* is designed as elastic element 40*a*, elastic element 40*a* being designed as helical spring 108*a*. A total of two helical springs 108*a* are situated between switching ring 92*a* and ring gear 94*a* of second gear stage 14*a*, helical springs 108*a* being supported on a supporting element 46*a* of switching ring 92*a* and on a supporting element 48*a* of ring gear 94*a* of second gear stage 14*a* in a manner similar to FIG. 3. Supporting element 46*a* of switching ring 92*a* is designed in such a way that helical springs 108*a* may be supported on supporting element 46*a* in any operating position of switching ring 92*a*. For this purpose, supporting element 46*a* extends over a largely total width of switching ring 92*a* along axial direction 42*a*. Helical springs 108*a* may be additionally guided in a groove which is situated in an outer side of ring gear 94*a* of second gear stage 14*a*. By situating helical springs 108*a* in this manner, switching ring 92*a* is able to move relative to ring gear 94*a* of second gear stage 14*a* along a circumferential direction 20*a*. Furthermore, switching ring 92*a* is mounted such that it may move relative to ring gear 94*a* of second gear stage 14*a* along an axial direction 42*a*.

In a switching operation of planetary gear 84*a* from a first gear of planetary gear 84*a* to a second gear of planetary gear 84*a*, switching ring 92*a* is moved along axial direction 42*a* in the direction of first gear stage 12*a*, a locking element 36*a* of switching ring 92*a* disengaging from a locking geometry 146*a* of a component 148*a* which is situated in a non-twistable manner in relation to a housing 54 of cordless screwdriver 50. Locking element 36*a* is designed to form a single piece with supporting element 46*a* of switching ring 92*a*. Ring gear 94*a* of second gear stage 14*a* retains its position in axial direction 42*a* during the entire switching operation. Ring gear 94*a* of second gear stage 14*a* is situated between a planetary carrier 88*a* of first gear stage 12*a* and a planetary carrier 120*a* of second gear stage 14*a* along axial direction 42*a*. Ring gear 94*a* of second gear stage 14*a* is thus axially secured and retains its position in axial direction 42*a*.

Switching ring 92*a* has an inner toothed structure 150*a* which is formed by supporting element 46*a* and is oriented in the direction of ring gear 94*a* of second gear stage 14*a*. However, it is also conceivable for inner toothed structure 150*a* to run largely along entire circumferential direction 20*a* and at least partially surround supporting element 46*a* of switching ring 92*a*. Inner toothed structure 150*a* engages with an outer toothed structure 138*a* of planetary carrier 88*a* of first gear stage 12*a* during the switching operation and thus couples ring gear 94*a* of second gear stage 14*a* with planetary carrier 88*a* of first gear stage 12*a*. A torque shock produced by different rotational speeds between switching ring 92*a* and ring gear 94*a* of second gear stage 14*a* during the engagement of inner toothed structure 150*a* of switching ring 92*a* with outer toothed structure 138*a* of planetary carrier 88*a* of first gear stage 12*a* is damped by helical springs 108*a*.

When switching ring gear 26*a* is switched from the second gear of planetary gear 84*a* to the first gear of planetary gear 84*a*, switching ring gear 26*a* is moved along axial direction 42*a* in the direction of third gear stage 82*a*. Inner toothed structure 150*a* of switching ring 92*a* disengages from outer toothed structure 138*a* of planetary carrier 88*a* of first gear stage 12*a*. Planetary wheels 100*a* of second gear stage 14*a* are disengaged thereby from planetary carrier 88*a* of first gear stage 12*a*. Due to the movement of switching ring gear 26*a* along axial direction 42*a* in the direction of third gear stage 82*a*, locking element 36*a* of switching ring 92*a* engages with locking geometry 146*a* of component 148*a*, which is non-twistably situated in housing 54, a torque shock being produced between switching ring 92*a* and ring gear 94*a* of second gear stage 14*a* due to the engagement of locking element 36*a* of switching ring 92*a* with locking geometry 146*a* of component 148*a* which is non-twistably situated in housing 54. This torque shock is dampened by helical springs 108*a* between switching ring 92*a* and ring gear 94*a* of second gear stage 14*a*. Switching ring gear 26*a* is connected to housing 54 in a largely non-twistable manner after the switching operation. Ring gear 94*a* of second gear stage 14*a* retains its position in axial direction 42*a* during the entire switching operation from the second gear of planetary gear 84*a* to the first gear of planetary gear 84*a*.

What is claimed is:

1. A power tool gear device, comprising:

a first gear stage;

a second gear stage; and a switching element configured to be moved by an operator using an actuating element, wherein the switching element at least partially surrounds at least one of the first and second gear stages in at least one operating position along a circumferential direction, and wherein the switching element is configured to switch between a first operating position and a second operating position, and wherein the switching element includes a switching ring, and an elastic element, wherein the switching ring has a first locking element configured for non-rotatable connection of the switching ring to a housing in the first operating position, a second locking element configured for rotatable connection of the switching ring to a planetary carrier in the second operating position, and at least one supporting element projecting radially inwardly towards the ring gear, wherein the ring gear has an inner toothed structure and at least one supporting element projecting radially outwardly towards the switching ring, wherein the elastic element is supported on the at least one supporting element of the switching ring by one end and on the at least one supporting element of the ring gear by an opposite end such that the elastic element is configured to provide a relative movement between the switching ring and the ring gear.

2. The power tool gear device as recited in claim 1, wherein the first component is at least partially formed by a first ring element and the second component is at least partially formed by a second ring element.

3. The power tool gear device as recited in claim 1, wherein the first component at least partially covers the second component along a radial direction at least in one operating position.

4. The power tool gear device as recited in claim 1, wherein the first component and the second component substantially surround a receptacle area.

5. The power tool gear device as recited in claim 1, wherein the first component includes at least one locking element.

6. The power tool gear device as recited in claim 5, wherein the first component has at least one positive-locking element configured to at least partially engage behind the second component in an axial direction.

7. The power tool gear device as recited in claim 5, wherein the first component has at least one supporting element running in a radial direction, the supporting element being oriented in the direction of the second component.

8. The power tool gear device as recited in claim 7, wherein the supporting element is configured to at least partially transmit a force from the first component to the second component.

9. The power tool gear device as recited in claim 5, wherein the second component has at least one supporting element running in a radial direction, the supporting element being oriented in the direction of the first component.

10. The power tool gear device as recited in claim 1, wherein the elastic element is situated between the first component and the second component at least in one direction.

11. The power tool gear device as recited in claim 1, wherein the first component is directly connected to the second component at least via the elastic element.

12. The power tool gear device as recited in claim 1, wherein the first component is mechanically connected to the second component at least via the elastic element.

13. The power tool gear device as recited in claim 1, wherein the first component is movably mounted relative to the second component along the circumferential direction.

14. The power tool gear device as recited in claim 1, wherein the first component is movably mounted relative to the second component along the axial direction.

15. The power tool gear device as recited in claim 1, wherein the switching element is configured to move in an axial direction upon switching between the first operating position and the second operating position.

16. A power tool gear device, comprising:

a first gear stage;

a second gear stage; and a switching element configured to be moved for switching between the first gear stage and the second gear stage, wherein the switching element at least partially surrounds at least one of the first and second gear stages in at least one operating position along a circumferential direction, and wherein the switching element is configured to switch between a first operating position and a second operating position, and wherein the switching element includes a switching ring, and an elastic element, wherein the switching ring has a first locking element configured for non-rotatable connection of the switching ring to a housing in the first operating position, a second locking element configured for rotatable connection of the switching ring to a planetary carrier in the second operating position, and at least one supporting element projecting radially inwardly towards the ring gear, wherein the ring gear has an inner toothed structure and at least one supporting element projecting radially outwardly towards the switching ring, wherein the elastic element is supported on the at least one supporting element of the switching ring by one end and on the at least one supporting element of the ring gear by an opposite end such that the elastic element is configured to provide a relative movement between the switching ring and the ring gear.

* * * * *